US010487775B2

(12) United States Patent
Leone

(10) Patent No.: US 10,487,775 B2
(45) Date of Patent: Nov. 26, 2019

(54) SYSTEMS AND METHODS FOR PISTON COOLING

(71) Applicant: Ford Global Technologies, LLC, Dearborn, MI (US)

(72) Inventor: Thomas G. Leone, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 351 days.

(21) Appl. No.: 15/421,159

(22) Filed: Jan. 31, 2017

(65) Prior Publication Data

US 2017/0138298 A1 May 18, 2017

Related U.S. Application Data

(62) Division of application No. 14/688,754, filed on Apr. 16, 2015, now Pat. No. 9,605,620.

(51) Int. Cl.

| | |
|---|---|
| ***F02F 3/22*** | (2006.01) |
| ***F01M 1/08*** | (2006.01) |
| ***F01M 1/14*** | (2006.01) |
| ***F01P 3/08*** | (2006.01) |
| ***F01M 1/16*** | (2006.01) |

(52) U.S. Cl.

CPC ..... *F02F 3/22* (2013.01); *F01M 1/08* (2013.01); *F01M 1/14* (2013.01); *F01M 1/16* (2013.01); *F01P 3/08* (2013.01)

(58) Field of Classification Search

CPC ..... F02F 3/16; F02F 3/20; F02F 3/22; F01M 1/08; F01M 1/14; F01M 1/16; F01P 3/08; F01P 3/06; F01P 7/14; F01P 2007/146

See application file for complete search history.

(56) References Cited

U.S. PATENT DOCUMENTS

| | | | | |
|---|---|---|---|---|
| 2,456,668 A | | 12/1948 | Anderson | |
| 2,991,770 A | * | 7/1961 | Rausch | F01P 3/08 123/41.35 |
| 4,398,507 A | | 8/1983 | Belsanti | |
| 4,567,815 A | | 2/1986 | Kocher | |

(Continued)

FOREIGN PATENT DOCUMENTS

| | | |
|---|---|---|
| CN | 1948740 A | 4/2007 |
| CN | 102086901 A | 6/2011 |

(Continued)

OTHER PUBLICATIONS

China National Intellectual Property Administration, Office Action and Search Report Issued in Application No. 201610237911.5, dated Jul. 16, 2019, 11 pages. (Submitted with Partial Translation).

(Continued)

*Primary Examiner* — Grant Moubry

(74) *Attorney, Agent, or Firm* — Geoffrey Brumbaugh; McCoy Russell LLP

(57) ABSTRACT

Methods and systems are provided for supplying cooling oil to a piston of an engine cylinder. In one example, a method may include repeatedly activating an oil supply only during a part of a cylinder cycle synchronous with a reciprocating motion of the piston. In particular, supply of cooling oil may be initiated by displacing a poppet valve arranged within a piston cooling assembly via a reciprocating motion of the piston.

11 Claims, 6 Drawing Sheets

(56) References Cited

U.S. PATENT DOCUMENTS

| | | | | |
|---|---|---|---|---|
| 4,697,498 | A | 10/1987 | Yoshikawa et al. | |
| 4,907,545 | A | 3/1990 | Mills | |
| 5,046,930 | A | 9/1991 | Lindstrom | |
| 5,067,393 | A | 11/1991 | Kawasaki et al. | |
| 5,152,373 | A | 10/1992 | Callies | |
| 5,533,472 | A | 7/1996 | Sands et al. | |
| 5,669,285 | A | 9/1997 | Wiczynski et al. | |
| 5,819,692 | A * | 10/1998 | Schafer | F01P 3/08 123/41.35 |
| 6,250,275 | B1 | 6/2001 | Bock et al. | |
| 6,298,810 | B1 | 10/2001 | Chimonides et al. | |
| 6,481,389 | B2 | 11/2002 | Suzuki et al. | |
| 6,907,848 | B2 | 6/2005 | Beardmore | |
| 6,955,142 | B2 | 10/2005 | Patel et al. | |
| 7,753,024 | B2 | 7/2010 | Hausler et al. | |
| 7,866,295 | B2 | 1/2011 | Shi et al. | |
| 7,975,806 | B2 | 7/2011 | Glass | |
| 8,065,985 | B2 | 11/2011 | Schneider | |
| 8,408,166 | B1 | 4/2013 | Zhou et al. | |
| 8,695,559 | B2 | 4/2014 | Bohm | |
| 8,739,746 | B2 * | 6/2014 | Bidner | F01M 1/08 123/196 R |
| 9,605,571 | B2 * | 3/2017 | Ishikawa | F01M 1/04 |
| 9,803,521 | B2 * | 10/2017 | D'Epiro | F01P 3/06 |
| 2003/0037668 | A1 | 2/2003 | Nastasi | |
| 2005/0076858 | A1 | 4/2005 | Beardmore | |
| 2008/0271597 | A1 | 11/2008 | Soul | |
| 2013/0160724 | A1 * | 6/2013 | Yamamoto | F01P 3/08 123/41.35 |
| 2013/0179049 | A1 * | 7/2013 | Grieser | F02D 45/00 701/102 |
| 2013/0192547 | A1 * | 8/2013 | Bowler | F01M 1/16 123/90.13 |
| 2014/0020648 | A1 | 1/2014 | Azevedo et al. | |
| 2015/0047581 | A1 | 2/2015 | D'Epiro | |
| 2016/0305363 | A1 | 10/2016 | Leone et al. | |
| 2017/0016364 | A1 * | 1/2017 | Kazaoka | F01M 1/08 |

FOREIGN PATENT DOCUMENTS

| | | | | |
|---|---|---|---|---|
| CN | 102242667 | A | 11/2011 | |
| CN | 102705101 | A | 10/2012 | |
| GB | 2431219 | A | 4/2007 | |
| JP | S63147910 | A | 6/1988 | |
| JP | H03168317 | A | 7/1991 | |
| JP | 2003301744 | A | 10/2003 | |
| JP | 2014088844 | A | 5/2014 | |
| KR | 20060063066 | A | 6/2006 | |
| KR | 20130073525 | A | 7/2013 | |
| WO | WO-2013156519 | A1 * | 10/2013 | F01P 3/06 |

OTHER PUBLICATIONS

China National Intellectual Property Administration, Office Action and Search Report Issued in Application No. 201610237780.0, dated Jul. 16, 2019, 14 pages. (Submitted with Partial Translation).

* cited by examiner

SYSTEMS AND METHODS FOR PISTON COOLING

CROSS REFERENCE TO RELATED APPLICATION

The present application is a divisional of U.S. patent application Ser. No. 14/688,754, entitled "SYSTEMS AND METHODS FOR PISTON COOLING," filed on Apr. 16, 2015, the entire contents of which are incorporated herein by reference for all purposes.

FIELD

The present disclosure relates generally to methods and systems for piston cooling.

BACKGROUND/SUMMARY

Thermal loading of pistons within cylinders of an engine has increased in response to demands for higher power output and lower emissions. However, increased thermal loading of pistons can cause issues such as, engine seizures and engine degradation. Furthermore, designing pistons to avoid such degradation may involve higher-cost materials and manufacturing methods, or compromises in other desired attributes.

Lubrication systems may be used to cool various engine components during a dynamic range of engine operating conditions. For example, pistons may be cooled via piston cooling jets wherein oil is sprayed at an underside of the piston. An example piston cooling assembly is described by Chimonides et al. in U.S. Pat. No. 6,298,810 wherein an oil nozzle is located on an engine block to supply oil to the underside of the piston. The inventors herein have recognized potential issues with piston cooling via piston cooling jets. For example, piston cooling jets may be operated in a continuous manner, such that cooling oil is constantly sprayed from the oil nozzle. As such, a larger proportion of the oil may be sprayed without cooling the piston due to the reciprocating motion of the piston. For example, much of the cooling oil may not reach the piston when the piston is at top dead center position in the cylinder. Thus, larger amounts of oil may be sprayed towards the piston in order to effectively cool it. The pump pressurizing the oil may perform extra work, leading to a reduction in engine efficiency.

The inventors herein have recognized the above issues and identified approaches to at least partly address the issues. In one example, the issues described above may be at least partially addressed by a method for an engine, comprising repeatedly activating an oil supply only during a part of a cylinder cycle synchronous with a frequency of piston reciprocating motion. In this way, oil supply may be provided during a portion of the engine cycle and not in a continuous manner.

In another example, a system may be provided comprising an engine including a cylinder, a piston capable of reciprocating motion arranged within the cylinder, the piston including a skirt, and a lubrication system comprising an oil gallery, a pump, a piston cooling assembly fluidically coupled to the oil gallery, the piston cooling assembly positioned beneath the piston, and a poppet valve substantially blocking an opening of a nozzle of the piston cooling assembly, wherein the opening of the nozzle is unblocked by displacing the poppet valve via the skirt of the piston to initiate an oil supply through the piston cooling assembly. In this way, the piston actuates oil supply via displacing the poppet valve.

In another example, a method for an engine may be provided, comprising delivering oil to a piston during a first portion of a cylinder cycle, the piston arranged within a cylinder of the engine, and not delivering the oil to the piston during a second portion of the cylinder cycle.

For example, an engine may comprise at least one cylinder with a reciprocating piston arranged within the at least one cylinder. A piston cooling assembly including a valve body, poppet valve, and a nozzle may be positioned near the piston. The piston cooling assembly may be positioned such that during a first portion of an engine cycle, a skirt of the piston displaces the poppet valve of the piston cooling assembly allowing a flow of oil from the nozzle. The first portion of the cylinder cycle may include a duration when the piston is substantially at bottom dead center position such as during each of an intake stroke and an expansion stroke of the cylinder cycle. Further, oil flow may not be initiated during a second portion of the cylinder cycle. The second portion of the cylinder cycle may include a duration when the piston is substantially away from bottom dead center position.

In this way, a piston in an engine may be cooled to reduce degradation. By using piston motion to actuate a cooling oil supply, additional control mechanisms may not be desired. As such, the oil supply is actuated only during a portion of a cylinder cycle when the piston is near the piston cooling assembly. Thus, oil flow may be directed to and may cool the piston in a more reliable manner, with less waste of pressurized oil. Overall, the piston may be cooled more efficiently with less oil pump work, enabling improved efficiency of the engine.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
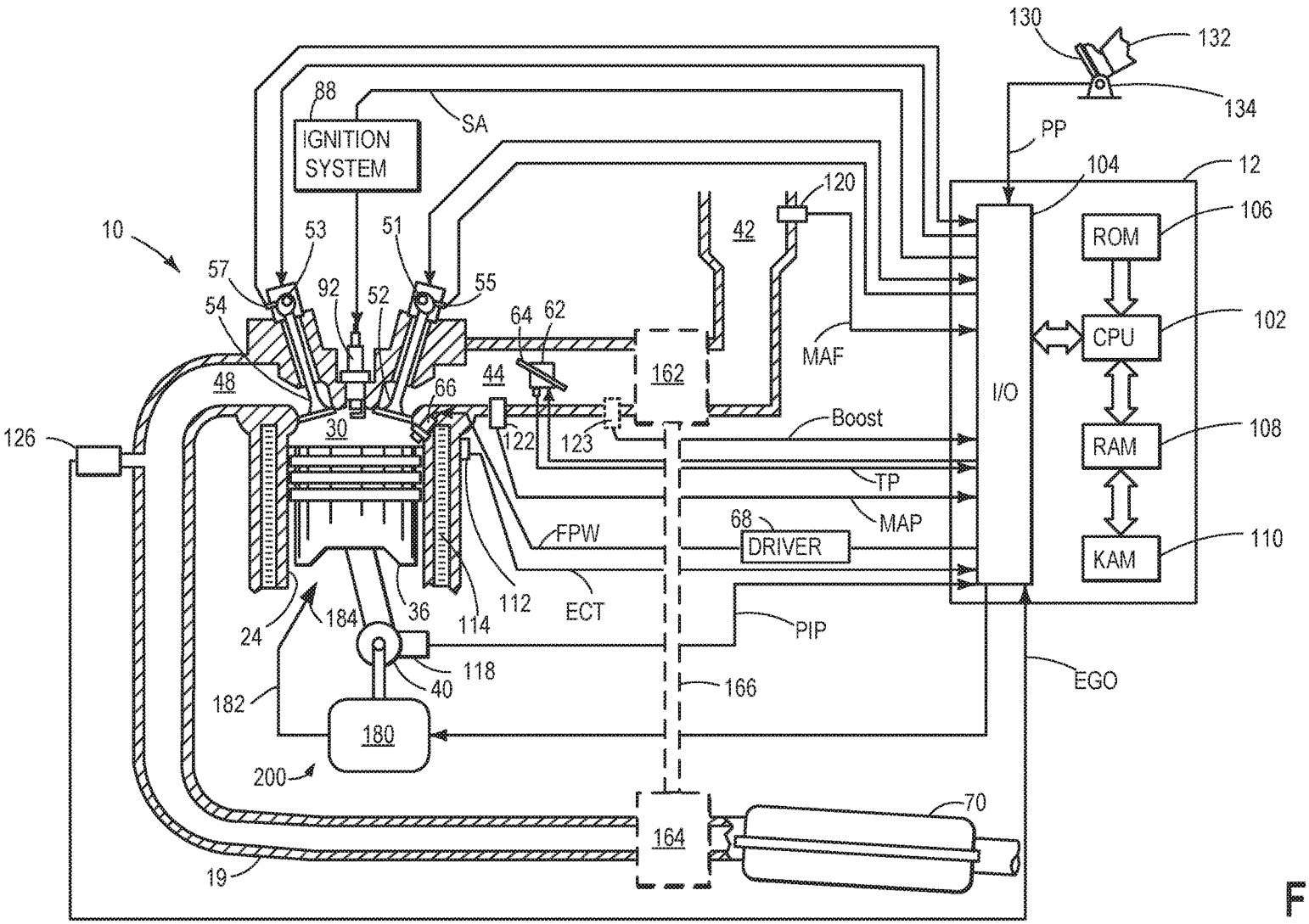
FIG. 1 shows a schematic diagram of an example engine.
Figure 2:
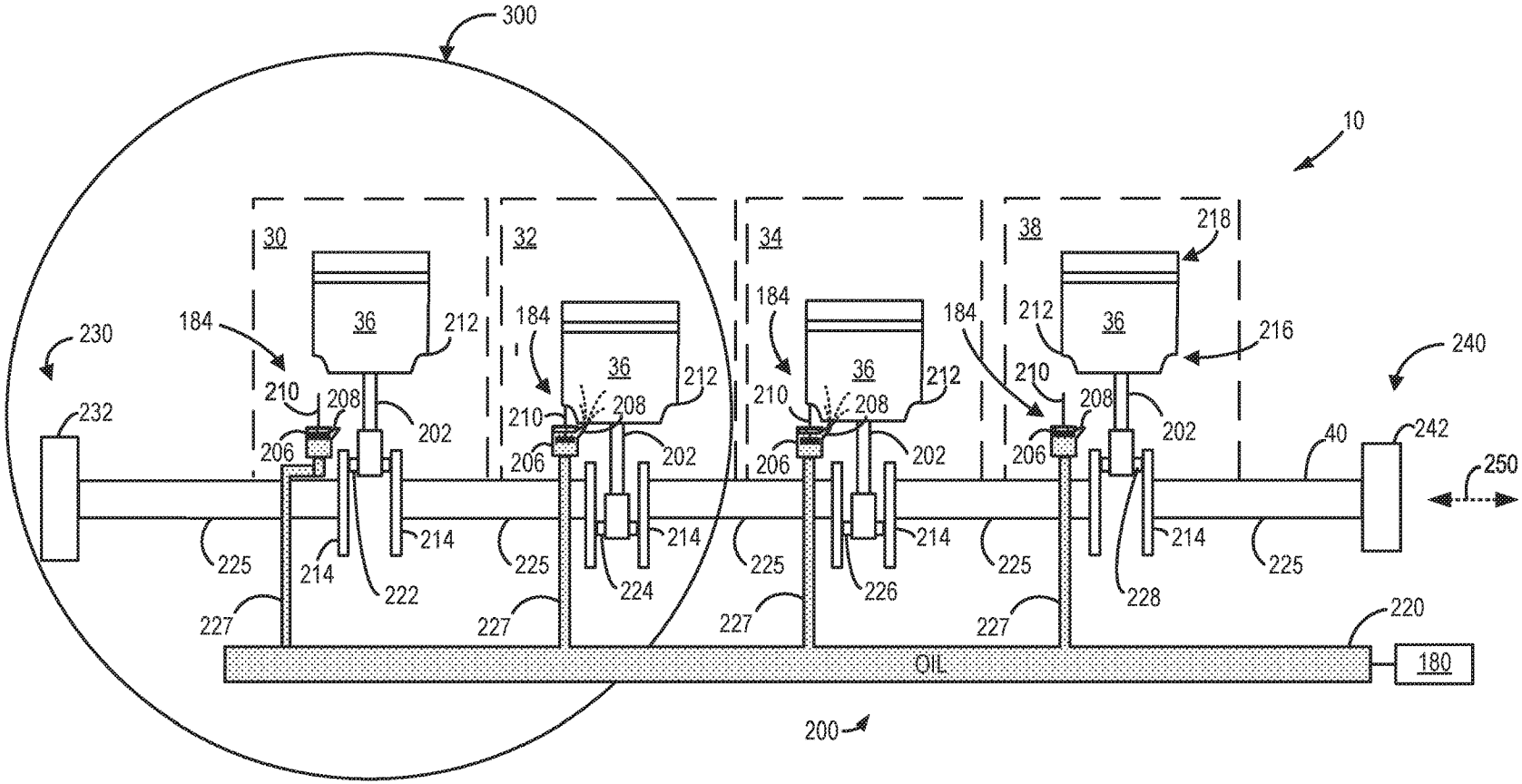
FIG. 2 schematically portrays an example engine oil delivery system, in accordance with the present disclosure.
Figure 3:
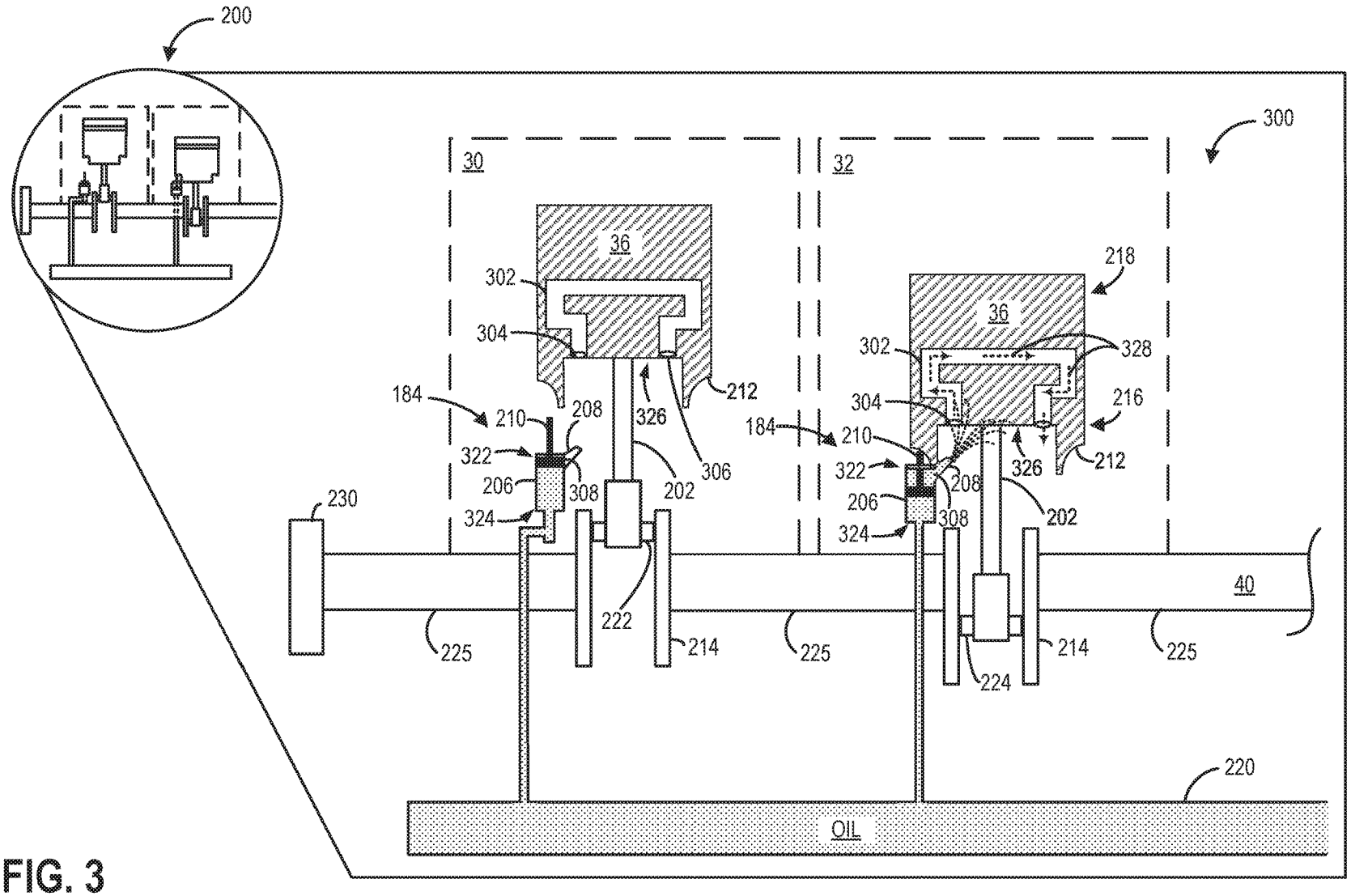
FIG. 3 shows a magnified view of the example engine oil delivery system of FIG. 2.
Figure 4:
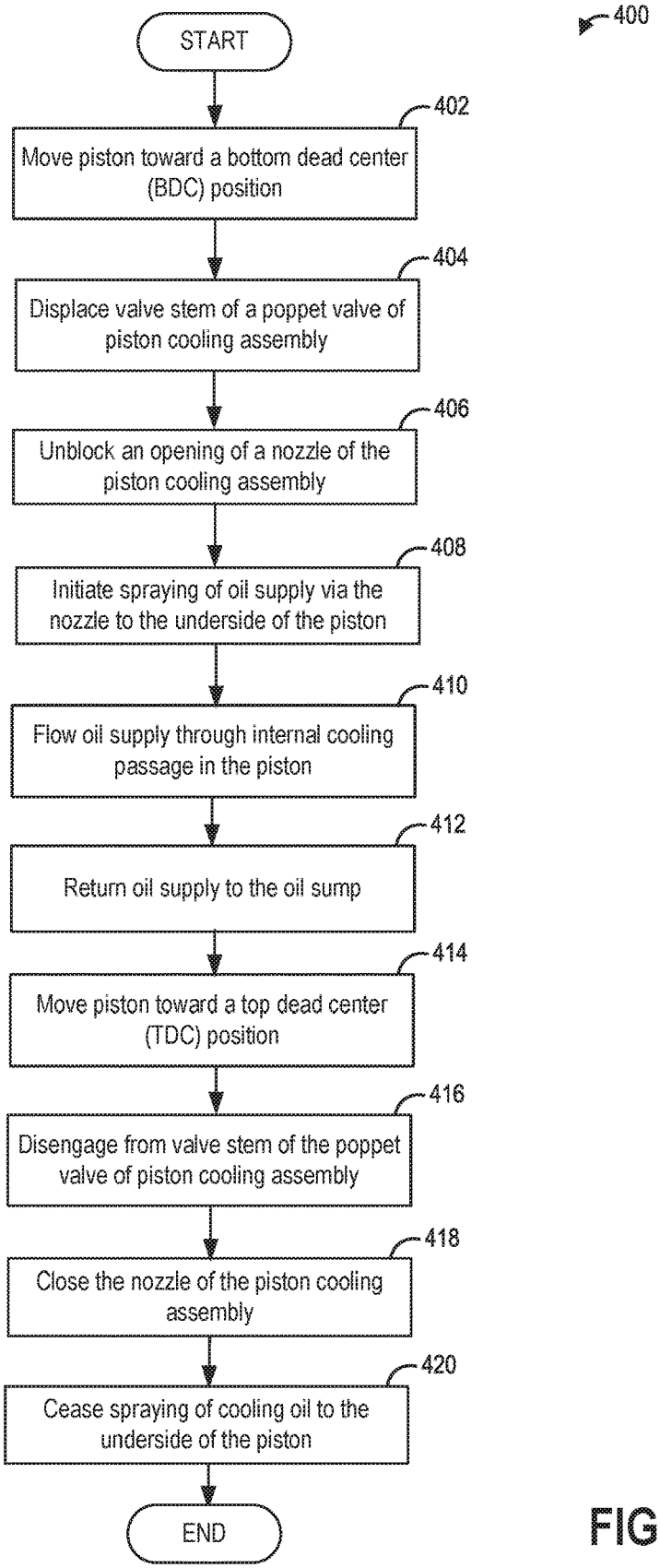
FIG. 4 is a flow chart for an example method for piston cooling, according to the present disclosure.
Figure 5:
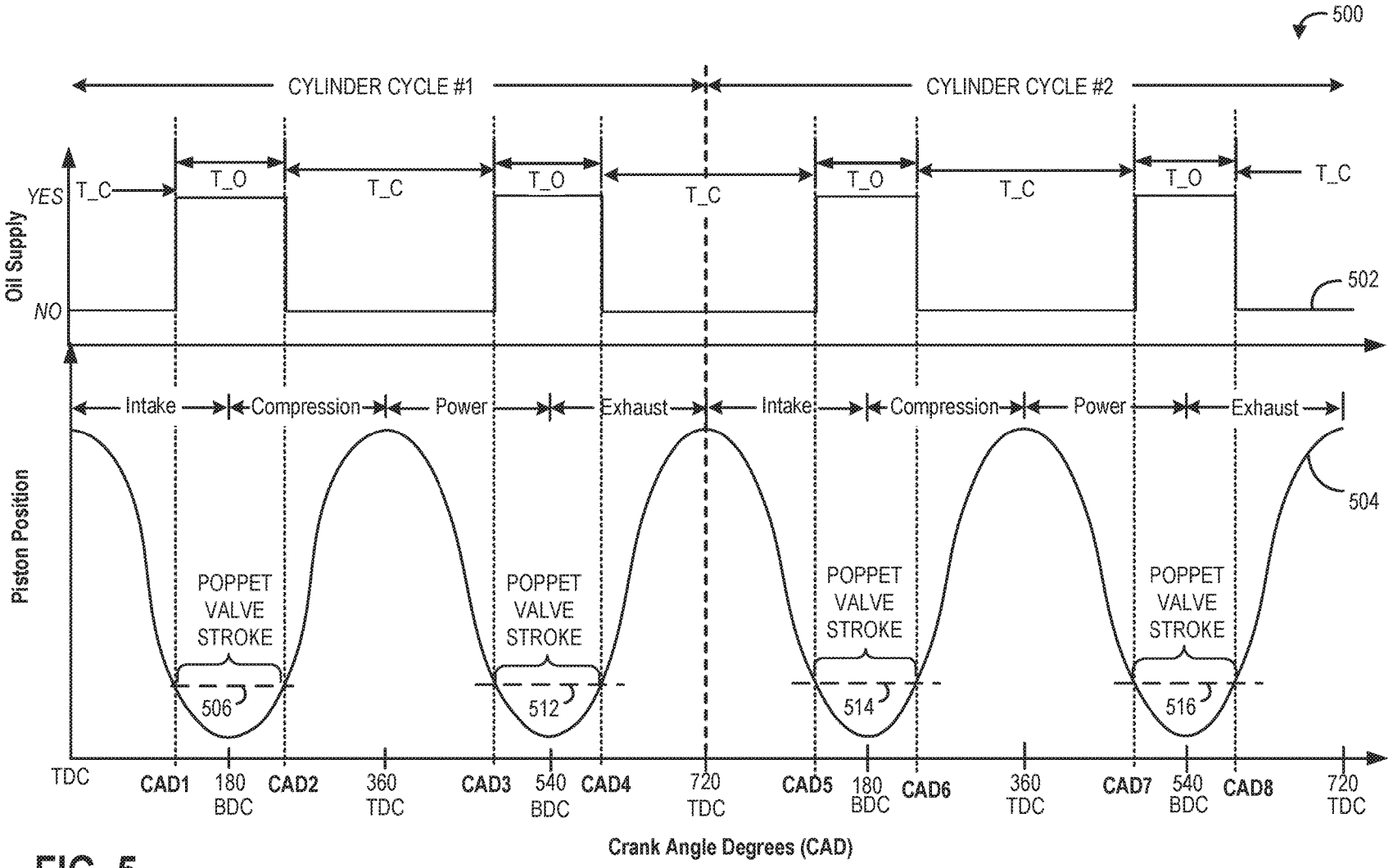
FIG. 5 depicts an example oil supply to a piston of a cylinder of the example engine of FIG. 1 during subsequent cylinder cycles.
Figure 6:
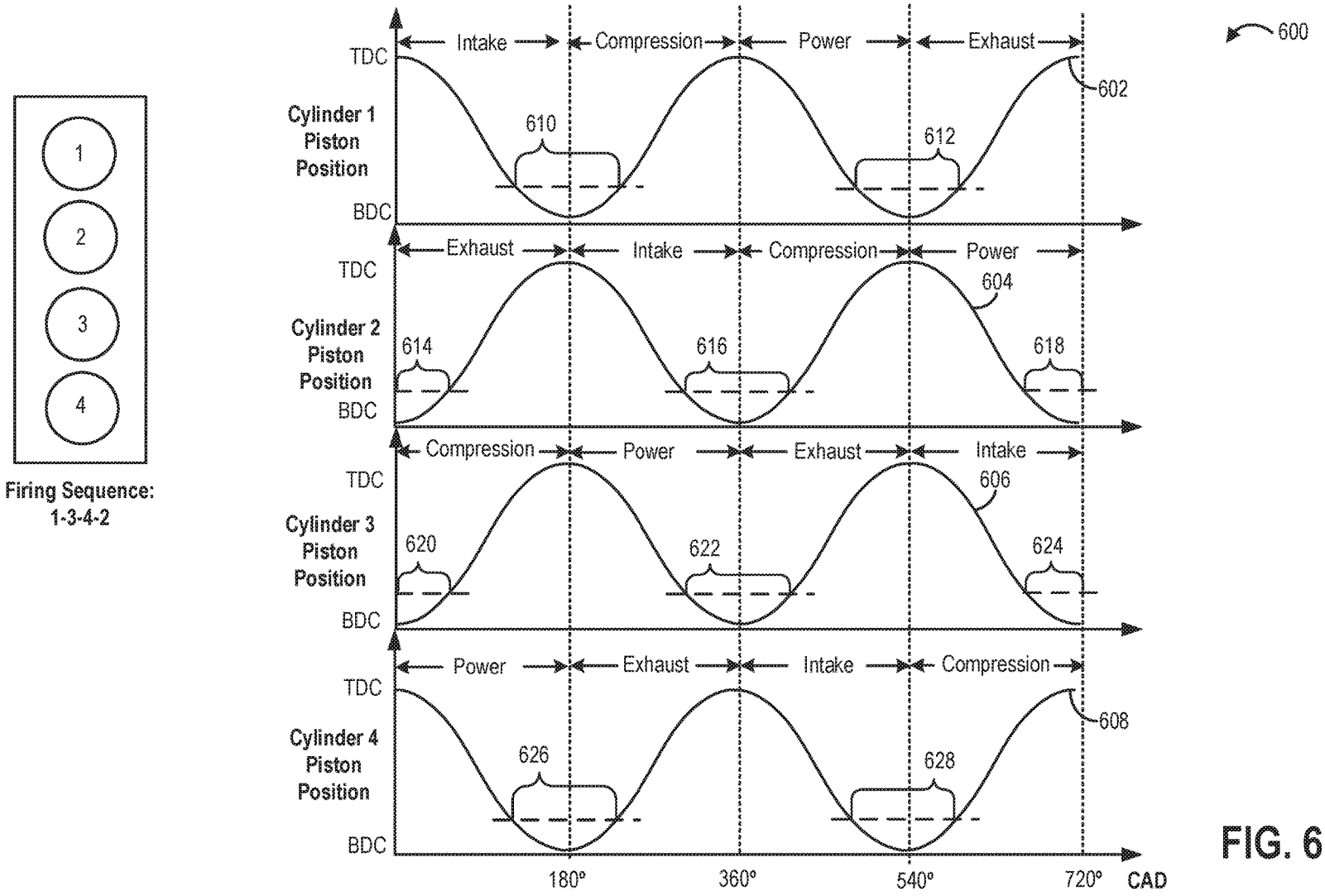
FIG. 6 illustrates an example oil supply in four engine cylinders of the example engine of FIG. 1 during a single, common engine cycle.

The following description relates to systems and methods for cooling a piston in an engine, such as the engine shown in FIG. 1. The engine comprises a plurality of pistons, each piston reciprocating within a cylinder of the engine, and a crankshaft lubricated and cooled by a lubrication system having an oil pump, an oil gallery, and multiple piston cooling assemblies, as depicted in FIG. 2. Each of the plurality of pistons may receive cooling oil via an associated piston cooling assembly. A piston cooling assembly may comprise a poppet valve, a valve body, and a nozzle, as shown in FIG. 3. The piston cooling assembly may spray oil onto the associated piston when the associated piston reaches bottom dead center (BDC) position. Further, as the associated piston proceeds towards top dead center (TDC), the oil supply may be terminated. Thus, oil supply may be repeatedly activated only during a portion of each cylinder cycle (FIGS. 4 and 5). Further still, in a four-cylinder engine during a single, common engine cycle, oil may be supplied to two of the four cylinders simultaneously while the remaining two cylinders do not receive oil (FIG. 6).

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Engine 10 shows an example cylinder 30 (also known as combustion chamber 30). Combustion chamber 30 of engine 10 may include combustion chamber walls 24 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust manifold 48. Intake manifold 44 and exhaust manifold 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. For example, valve operation may be varied as part of pre-ignition abatement or engine knock abatement operations. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Engine 10 may optionally include a compression device such as a turbocharger or supercharger including at least a compressor 162 arranged along intake passage 42. For a turbocharger, compressor 162 may be at least partially driven by a turbine 164 (e.g., via a shaft 166) arranged along exhaust passage 19. For a supercharger, compressor 162 may be at least partially driven by the engine and/or an electric machine, and may not include a turbine. Thus, the amount of compression provided to one or more cylinders of the engine via a turbocharger or supercharger may be varied by controller 12. A boost sensor 123 may be positioned downstream of the compressor in intake manifold 44 to provide a boost pressure (Boost) signal to controller 12.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30. Fuel injector 66 may be controlled to vary fuel injection in different cylinder according operating conditions.

Intake passage 42 is shown with throttle 62 including throttle plate 64 whose position controls airflow. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and intake manifold 44 may include a manifold air pressure sensor 122 for providing respective signals MAF and MAP to controller 12.

Exhaust gas sensor 126 is shown coupled to exhaust passage 19 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOR, HC, or CO sensor. The exhaust system may include light-off catalysts and underbody catalysts, as well as exhaust manifold, upstream and/or downstream air-fuel ratio sensors. Catalytic converter 70 can include multiple catalyst bricks, in one example. In another example, multiple emission control devices, each with multiple bricks, can be used. Catalytic converter 70 can be a three-way type catalyst in one example.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines. In one example, ignition events in a four-cylinder engine may be configured to occur in the following order: 1-3-2-4.

Engine 10 includes a lubrication described in reference to FIGS. 2 and 3, for providing engine component cooling and lubrication. Lubrication system 200 includes an oil pump 180, an oil sump (not shown), and at least one piston cooling assembly 184. Piston cooling assembly 184 is associated with cylinder 30 and piston 36. Pistons arranged in remaining cylinders of engine 10 may be cooled via similar corresponding piston cooling assemblies. In one embodiment, oil pumped by oil pump 180 is routed through at least one oil gallery, such as an oil gallery 182, to one or more engine components. In this way, oil pump 180 may provide oil to various regions and/or components of engine 10 to provide cooling and lubrication. For example, oil may be pumped by oil pump 180 through oil gallery 182 to cool an underside of piston 36 via piston cooling assembly 184. In other examples, oil may be pumped by oil pump 180, or additional oil pumps (not shown) via the oil gallery 182 and/or alternative channels (not shown) to other engine components including, for example, turbine bearings (not shown), and a variable camshaft timing system (not shown) in engine 10. An example lubrication system configuration, according to this disclosure, is described below in reference to FIG. 2.

Oil pump 180 can be coupled to crankshaft 40 to provide rotary power to operate the flow of oil via oil pump 180. In another example, oil pump 180 may be an electric pump. In alternative embodiments, the oil pump may be a variable flow oil pump. It will be appreciated that any suitable oil pump configuration may be implemented to vary the oil pressure and/or oil flow rate. In some embodiments, instead of being coupled to the crankshaft 40 the oil pump 180 may be coupled to a camshaft, or may be powered by a different power source, such as a motor or the like. The oil pump 180 may include additional components not depicted in FIG. 1, such as a hydraulic regulator, electro-hydraulic solenoid valve, etc.

Piston cooling assembly 184 may be fluidically coupled to the oil gallery 182 and may receive oil pumped by oil pump 180 from the oil sump (not shown). In another example, piston cooling assembly 184 may be incorporated into the combustion chamber walls 24 of the engine cylinder and may receive oil from galleries formed in the walls. The piston cooling assembly 184 may be operable to spray oil onto an underside of piston 36 only during a part of a cylinder cycle. The oil squirted by piston cooling assembly 184 provides cooling to the piston 36. Furthermore, in other examples, through reciprocation of piston 36, oil is drawn up into combustion chamber 30 to provide cooling effects to walls of the combustion chamber 30. In one embodiment, controller 12 may adjust operation of the oil pump 180 in response to various operating conditions, such as engine temperature, engine speed, etc. For example, when the oil pump 180 is a variable flow oil pump, the controller may adjust oil output to adjust oil injection of the piston cooling assembly 184 to be injected onto the piston 36.

Controller 12 is shown in FIG. 1 as a microcomputer, including microprocessor unit 102, input/output ports 104, an electronic storage medium for executable programs and calibration values shown as read only memory 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; a profile ignition pickup signal (PIP) from Hall effect sensor 118 (or other type) coupled to crankshaft 40; throttle position (TP) from a throttle position sensor; and absolute manifold pressure signal, MAP, from pressure sensor 122. Engine speed signal, RPM, may be generated by controller 12 from signal PIP.

Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, Hall effect sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and that each cylinder may similarly include its own set of intake/exhaust valves, fuel injector, spark plug, oil injector, etc.

During engine operation, each cylinder of the engine, e.g. engine 10, may undergo a four stroke cycle, also termed a cylinder cycle. The four stroke cycle, or the cylinder cycle, includes an intake stroke, compression stroke, expansion stroke, and exhaust stroke. During the intake stroke, generally, the exhaust valves close and intake valves open. Air is introduced into the cylinder, e.g., cylinder 30, via the intake passage, and the cylinder piston, e.g., piston 36, moves to the bottom of the cylinder so as to increase the volume within the cylinder. The position at which the piston is near the bottom of the cylinder and at the end of its stroke (e.g., when the combustion chamber is at its largest volume) is typically referred to by those of skill in the art as bottom dead center (BDC). During the compression stroke, the intake valves and exhaust valves are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel is ignited by known ignition means, such as a spark plug, resulting in combustion. During the expansion stroke, the expanding gases push the piston back to BDC. During the exhaust stroke, in a traditional design, exhaust valves are opened to release the residual combusted air-fuel mixture to the corresponding exhaust passages and the piston returns to TDC. A crankshaft, such as crankshaft 40 of FIG. 1, converts this piston movement into a rotational torque of the rotary shaft. An engine cycle includes two revolutions of the crankshaft. Further, a single, engine cycle may be equivalent to one cylinder cycle for a single cylinder of the engine. To elaborate, an engine cycle includes 720 degrees of crank rotation. During the 720 degrees of crank rotation, a single cylinder of the engine may undergo one cylinder cycle. Now turning to FIG. 2, an example crankshaft 40 of engine 10 is shown coupled to a lubrication system 200, wherein the lubrication system 200 includes a plurality of piston cooling assemblies 184, an oil gallery 220, and the oil pump 180. Engine 10 of FIG. 2 may be similar to engine 10 of FIG. 1. As such, components previously introduced in FIG. 1 are numbered similarly in FIG. 2 and not reintroduced.

A plurality of pistons 36 may be coupled to crankshaft 40, as shown. Each of the plurality of pistons 36 is arranged within a corresponding cylinder. As such, engine 10 includes four cylinders: a first cylinder 30, a second cylinder 32, a third cylinder 34, and a fourth cylinder 38. Further, engine 10 may be an inline four-cylinder engine. FIG. 2 depicts four pistons 36 arranged in a single row along a length of the crankshaft 40. In others examples, the four cylinders may be arranged in another configuration, such as a V-shaped orientation. In alternate embodiments, engine 10 may include more than or fewer than 4 cylinders.

Crankshaft 40 comprises a crank nose end 240 (also termed front end) with crank nose 242 for mounting pulleys and/or for installing a harmonic balancer (not shown) to reduce torsional vibration. Crankshaft 40 further includes a flange end 230 (also termed rear end) with a flange 232 configured to attach to a flywheel (not shown). Crankshaft 40 in engine 10 is driven by reciprocating motion of pistons 36 coupled to crankshaft 40 via connecting rods 202. Energy generated via combustion may be transferred from the pistons to the crankshaft and flywheel, and thereon to a transmission (not shown) thereby providing motive power to a vehicle.

Crankshaft 40 may also comprise a plurality of pins, journals, webs (also termed, cheeks), and counterweights. In the depicted example, crankshaft 40 includes five main bearing journals 225, wherein each main bearing journal 225 is aligned with a central axis of rotation 250 of crankshaft 40. The main bearing journals support bearings that are configured to enable rotation of crankshaft 40 while providing support to the crankshaft. In alternate embodiments, the crankshaft may have more or less than five main bearing journals.

Crankshaft 40 may include four crank pins such as a first crank pin 222, a second crank pin 224, a third crank pin 226, and a fourth crank pin 228, each crank pin mechanically and pivotally coupled to respective connecting rods 202, and thereby, respective pistons 36 within each of first cylinder 30, second cylinder 32, third cylinder 34, and fourth cylinder 38. Further, the four crank pins are arranged sequentially from crank nose end 240 to flange end 230. Though crankshaft 40 is shown with four crank pins, crankshafts having an alternate number of crank pins have been contemplated. It will be appreciated that during engine operation, crankshaft 40 rotates around its central axis of rotation 250. Crank webs 214 may support each crank pin, and may further couple each of the crank pins to the main bearing journals. Further, crank webs 214 may be mechanically coupled to counterweights (not shown) to dampen oscillations in the crankshaft 40.

The crank pin arrangement may also mechanically constrain a firing order of 1-3-4-2. Herein, the firing order 1-3-2-4 may comprise firing first cylinder 30 followed by firing third cylinder 34. The fourth cylinder 38 may be fired after the third cylinder 34 and the second cylinder 32 may be fired after firing fourth cylinder 38.

In FIG. 2, the first crank pin 222 and fourth crank pin 228 are shown at similar positions relative to central axis of rotation 250. As such, the piston coupled to first crank pin 222 and the piston coupled to fourth crank pin 228 may be at TDC position. To elaborate, piston 36 coupled to first crank pin 222 and piston 36 coupled to fourth crank pin 228 may be at similar positions in their respective strokes. In other words, first crank pin 222 may also be aligned with fourth crank pin 228 relative to central axis of rotation 250. Further, the second crank pin 224 and the third crank pin 226 may also be at similar positions in their respective strokes around the central axis of rotation 250.

However, even though first crank pin 222 is depicted aligned with fourth crank pin 228, and each of the two pistons coupled to first crank pin 222 and fourth crank pin 228 is depicted in FIG. 2 at the TDC position, the two respective pistons may be at the end of different strokes. For example, the piston coupled to first crank pin 222 may be at the end of an exhaust stroke while the piston associated with fourth crank pin 228 may be at the end of a compression stroke. Thus, the piston coupled to first crank pin 222 may be 360 crank angle degrees (CAD) apart from the piston coupled to fourth crank pin 228 with respect to a 720 CAD engine cycle. Similarly, second crank pin 224 is depicted aligned with third crank pin 226, and each of the two pistons coupled to second crank pin 224 and fourth crank pin 226 is depicted in FIG. 2 at the BDC position. However, the two respective pistons may be at the end of different strokes, wherein the piston 36 coupled to second crank pin 224 may be at the end of a power stroke while the piston associated with third crank pin 226 may be at the end of a compression stroke. Thus, the piston coupled to second crank pin 224 may be 360 CAD apart from the piston coupled to third crank pin 226 with respect to a 720 CAD engine cycle.

FIG. 2 also illustrates lubrication system 200 as discussed in reference to FIG. 1. As shown, each piston cooling assembly 184 may be fluidically coupled to and receive oil from the oil gallery 220 via a respective oil receiving conduit 227. Further, the oil pump 180 may be fluidically coupled upstream of the oil gallery 220 such that oil pump 180 pumps oil to the oil gallery 220 from an oil sump (not shown).

Each piston cooling assembly 184 may be coupled (e.g., mechanically) to an engine block, in one embodiment. In another example embodiment, piston cooling assembly 184 may be coupled to a crankshaft bearing journal. Other forms of mounting the piston cooling assembly may be contemplated without departing from the scope of this disclosure. Each piston cooling assembly 184 may be positioned below its associated piston, such that a downward motion of the piston may contact at least a portion of the piston cooling assembly 184. Thus, each piston cooling assembly 184 may be positioned underneath its corresponding piston when the piston is at bottom dead center position. Further, the piston cooling assembly may be arranged towards a crankcase and not towards a cylinder head. As such, the cylinder head may be arranged vertically above the engine block (including the crankcase). Further still, the piston cooling assembly beneath each piston 36 may be positioned away from the associated cylinders.

Relative directions are noted herein with respect to an engine in a vehicle positioned on flat ground relative to gravity.

It will also be noted that the depicted example does not include any valves or intervening components in oil receiving conduits 227. Flow of oil via each piston cooling assembly is controlled by a respective poppet valve located within a valve body of the piston cooling assembly.

Each piston 36 of engine 10 receives oil from an associated piston cooling assembly 184. Since engine 10 is depicted as a four cylinder engine, FIG. 2 also includes four piston cooling assemblies 184. Each piston cooling assembly 184 includes a valve body 206, and a poppet valve 210 having a valve stem may be arranged therein. Valve body 206 of each piston cooling assembly 184 stores cooling oil received from oil gallery 220. The valve stem of the poppet valve 210 may be arranged orthogonal to the central axis of rotation 250. Other arrangements of the poppet valve may be contemplated without departing from the scope of this disclosure.

The valve stem of the poppet valve 210 may be at a given distance directly beneath a skirt 212 of the piston 36, the skirt 212 located at a lower end 216 of the piston 36. Specifically, lower end 216 of piston 36 includes a portion of piston 36 arranged towards crankshaft 40. As such, lower end 216 may be located opposite to an upper end 218 of piston 36. Upper end 218 of piston 36 may be arranged towards intake and exhaust valves in the corresponding cylinder. Further upper end 218 may include a crown of piston 36 which may be in direct contact with combustion gases within the corresponding cylinder. Though not indicated in FIG. 2, each piston 36 may include lower end 216 and upper end 218.

Piston cooling assembly 184 may be located beneath piston 36 such that skirt 212 of piston 36 contacts the valve stem of poppet valve 210 during a specific portion of an engine stroke. For example, as shown in FIG. 2, piston 36 of first cylinder 30 is at TDC and piston skirt 212 is away from poppet valve 210. Herein, the poppet valve is released and not in contact with piston skirt 212 of piston 36 of first cylinder 30. As piston 36 of first cylinder 30 travels from TDC towards BDC, piston skirt 212 of piston 36 may contact the valve stem of poppet valve 210. When piston skirt 212 contacts the valve stem of poppet valve 210, the downward motion of piston 36 may be incomplete. Thus, continued downward motion of piston 36 enables displacement of the valve stem of the poppet valve 210 via piston skirt 212. Specifically, the poppet valve 210 may be shifted in a direction towards the crankshaft 40 and oil held within valve body 206 may be released via nozzle 208. Thus, the downward motion of the poppet valve opens nozzle 208, allowing cooling oil to be delivered to an underside of piston 36.

The nozzle 208 of each piston cooling assembly 184 may be oriented at an angle such that oil squirted from nozzle 208 may be substantially directed towards the underside of piston 36. As such, piston 36 may include one or more cooling passages (e.g., internal cooling passages) to provide a conduit for cooling oil received from nozzle 208. Further, an inlet to the one or more cooling passages may be located on the underside of piston 36. Herein, the inlet to the one or more cooling passages may be also referred to as an opening to the one or more cooling passages. Thus, oil squirted from nozzle 208 may enter at least one inlet of cooling passages (shown below in reference to FIG. 3) located on the underside of the piston 36. Thus, by enabling oil supply from the piston cooling assemblies when the corresponding piston is near the nozzle (e.g., at or near BDC), a larger proportion of oil sprayed by the nozzle of the piston cooling assembly may enter the inlets of the one or more cooling passages in the piston.

As depicted in FIG. 2, pistons 36 of second cylinder 32 and third cylinder 34 may be at BDC while pistons 36 of first cylinder 30 and fourth cylinder 38 may be at TDC. Accordingly, pistons 36 of second cylinder 32 and third cylinder 34 may actuate and therefore, receive a supply of cooling oil. At the same time, since pistons 36 of first cylinder 30 and fourth cylinder 38 are at (or near) TDC, and consequently, away from the poppet valves of their corresponding piston cooling assemblies, neither piston receives an oil supply.

As shown in FIG. 2, skirts 212 of pistons 36 of second cylinder 32 and third cylinder 34 exert a force on each corresponding valve stem of the respective poppet valve 210. In response to the force exerted by each respective piston skirt 212, poppet valves 210 associated with second cylinder 32 and third cylinder 34 are opened and an amount of cooling oil may be injected to the underside of the piston 36 of second cylinder 32 and third cylinder 34. Poppet valve 210 may have a valve stroke allowing oil supply to be activated for at least 120 degrees of crank rotation in one cylinder cycle e.g. in 720 degrees of crank rotation, for each cylinder. In an example, poppet valve 210 may have a valve stroke allowing oil supply to be activated continuously for at least 60 degrees of crank rotation. For example, the oil supply may be activated in a given cylinder for approximately 60 degrees of crank rotation during a first cylinder stroke, and again for approximately 60 degrees of crank rotation during a second cylinder stroke, the first cylinder stroke and the second cylinder stroke occurring within a single, common cylinder cycle. Herein, the first cylinder stroke and the second cylinder stroke may not immediately follow each but may be separated by a distinct piston stroke in the cylinder. As an example, the first cylinder stroke may be an intake stroke within the given cylinder while the second cylinder stroke may be a subsequent expansion stroke within the given cylinder. In one example, during a single cylinder cycle in the given cylinder, the oil supply may be activated when the piston of the given cylinder is approximately 30 CAD before a first BDC position. Further, the oil supply may remain activated through the first BDC position of the piston. The oil supply may be deactivated approximately 30 CAD after the first BDC position as the piston travels towards a first TDC position. Furthermore, oil supply may be activated again during the same single cylinder cycle in the given cylinder when the piston of the given cylinder is approximately 30 CAD before a second BDC position, the second BDC position approached subsequent to the first TDC position. Oil supply to the given cylinder may remain activated through the second BDC position and may be discontinued approximately 30 CAD after the second BDC position. To elaborate, the first BDC position and the second BDC position occur within a single cylinder cycle of the given cylinder. The first BDC position may be at 180 CAD while the second BDC position may be at 540 CAD.

Thus, there may be two sets of approximately 60 degrees of crank rotation in one cylinder cycle. The two sets of approximately 60 degrees of crank rotation when the cooling oil supply is activated may not follow each other directly. Specifically, each duration of the 60 degrees of crank rotation when oil supply to the piston is activated is separated from a following or a previous duration of oil supply by a duration when oil supply is not provided to the piston. As such, a distance between the skirt 212 of piston 36 and the top end of the valve stem (exposed outside of valve body 206) of poppet valve 210 may be configured such that reciprocating motion of piston 36 enables contact and displacement of the valve stem of the poppet valve 210 by the skirt 212 for at least 120 degrees of crank rotation in one cylinder cycle for the given cylinder. In another example, reciprocating motion of piston 36 enables contact and displacement of the valve stem of the poppet valve 210 by the skirt 212 for at least 60 degrees of crank rotation in a continuous manner. Thus, there may be contact and displacement of the valve stem of the poppet valve 210 for two sets of approximately 60 degrees of crank rotation in one cylinder cycle.

While the present disclosure describes a poppet valve stroke enabling oil supply to the piston for at least 60 degrees of crank rotation continuously, other embodiments may include different durations of oil supply to the piston. In other words, distinct ranges of the poppet valve stroke (other than that providing oil supply for at least 120 degrees of crank rotation in one cylinder cycle) may be contemplated without departing from the scope of this disclosure.

Turning now to FIG. 3, a magnified view of the circled area 300 of FIG. 2 is shown. FIG. 3 specifically shows first cylinder 30 and second cylinder 32 of engine 10. As described earlier, each of first cylinder 30 and second cylinder 32 include respective reciprocating pistons 36. Components previously introduced in FIG. 2 are numbered similarly in FIG. 3 and not reintroduced.

First crank pin 222 is coupled to piston 36 in first cylinder 30, and second crank pin 224 is coupled to piston 36 in second cylinder 32. As elaborated earlier in reference to FIG. 2, piston 36 in second cylinder 32 is shown at or near BDC position (or approximately BDC position) compared with piston 36 in first cylinder 30, which is positioned near or at TDC position. In one example, piston 36 in first cylinder 30 may be at the end of its compression stroke when piston 36 of second cylinder 32 may be at the end of its intake stroke. In another example, piston 36 in first cylinder 30 may be at the end of its exhaust stroke while concomitantly piston 36 of second cylinder 32 is at the end of its power stroke.

As shown in the depicted example of FIG. 3, piston 36 in first cylinder 30 does not receive oil supply (e.g., since it is at or close to TDC) while piston 36 in second cylinder 32 is receiving oil (e.g., since it is at or close to BDC). Piston 36 in first cylinder 30 is positioned away from piston cooling assembly 184 associated with first cylinder 30 since the piston in first cylinder 30 is at or near TDC. Further, piston skirt 212 of piston 36 in first cylinder 30 is not in direct contact with the valve stem of poppet valve 210 associated with first cylinder 30. Thus, there may be no external force (e.g., from piston skirt 212) on the valve stem of poppet valve 210 associated with first cylinder 30 and poppet valve 210 may be released. Further still, poppet valve 210 associated with first cylinder 30 may be arranged at a first position towards a top 322 of valve body 206. In the first position, poppet valve 210 substantially blocks an opening 308 of nozzle 208 such that oil within valve body 206 is impeded from flowing through nozzle 208.

At the same time as piston 36 in first cylinder 30 is away from its associated piston cooling assembly 184, piston 36 of second cylinder 32 is in direct contact with the valve stem of its corresponding poppet valve 210. Specifically, skirt 212 at the lower end 216 of piston 36 in second cylinder 32 is in direct contact with the valve stem of poppet valve 210 of piston cooling assembly 184 associated with second cylinder 32. Further, skirt 212 of piston 36 in second cylinder 32 may force the valve stem from its initial position at top 322 of the valve body 206 towards a base 324 of the valve body 206. Specifically, as piston 36 of second cylinder 32 approaches BDC during one of the intake stroke and power stroke, the valve stem of the poppet valve 210 may be displaced in a downward direction towards crankshaft 40. As poppet valve 210 is pushed down, opening 308 of nozzle 208 is unblocked. As described earlier, poppet valve 210 may block opening 308 of nozzle 208 when piston skirt 212 of the associated piston 36 is away from (and not in direct contact with) the poppet valve 210.

Upon displacement of the poppet valve 210 by skirt 212 of piston 36 of second cylinder 32, the poppet valve 210 shifts away from opening 308. In response to the unblocking of opening 308 in nozzle 208, an oil supply stored in the valve body 206 may be sprayed towards underside 326 of the piston 36 of second cylinder 32. Specifically, a considerable portion of the oil may be sprayed towards underside 326 of piston 36. As shown in FIG. 3, underside 326 of piston 36 may include an inlet 304 of a cooling passage 302. The cooling passage 302 is arranged within an internal portion of the piston, such that cooling oil flowing through cooling passage 302 may provide adequate cooling to the piston. In one example, substantially all of the cooling oil sprayed by nozzle 208 of piston cooling assembly 184 may enter the cooling passage 302 through inlet 304. Cooling oil within cooling passage 302 is shown as dashed lines 328 with arrows indicating a flow direction. Thus, oil sprayed from nozzle 208 enters cooling passage 302 of piston 36 at inlet 304 and exits cooling passage 302 from outlet 306. Oil in cooling passage 302 may drip down (e.g., from outlet 306) to the oil sump within the crankcase (not shown). As such, in alternate embodiments where piston cooling assembly 184 is positioned closer to outlet 306 (and not near inlet 304, as shown in FIG. 3), oil sprayed via nozzle 208 may enter cooling passage 302 via outlet 306, and may exit via inlet 304.

While the depicted embodiment shows each piston 36 with a single cooling passage 302, in another embodiment, additional cooling passages may be included. Further, these additional passages may have separate and distinct inlets located on the underside 326 of the piston. Inlet 304 for the cooling passage 302 may be positioned at a location that improves a likelihood of receiving cooling oil from an associated piston cooling assembly. In yet another embodiment, cooling passage 302 may be omitted and the piston may simply be cooled by oil sprayed on the underside of the piston.

As such, nozzle 208 may be formed such that an outlet of nozzle 208 is inclined towards the underside 326 of the piston to squirt the cooling oil directly and efficiently into at least one inlet 304 of cooling passage 302 when the piston 36 is at or near BDC. In this way, by actuating oil supply via the piston cooling assembly 184 only when the associated piston is at or near BDC, a distance between the inlet for the cooling passages 302 of piston 36 and the outlet of the nozzle 208 may be reduced. Thus a more effective and precise delivery of cooling oil to the cooling passage 302 of piston 36 may be enabled. Accordingly, an interior of the piston may be sufficiently cooled in a more reliable manner.

In this manner, an example system, such as that shown in FIGS. 2-3, may be provided, comprising an engine including a cylinder, a piston capable of reciprocating motion arranged within the cylinder, the piston including a skirt, a lubrication system comprising an oil gallery, a pump, and a piston cooling assembly fluidically coupled to the oil gallery, and the piston cooling assembly positioned beneath the piston. Further, the engine may include a poppet valve substantially blocking an opening of a nozzle of the piston cooling assembly, and the opening of the nozzle may be unblocked by displacing the valve stem of the poppet valve via the skirt of the piston to initiate an oil supply through the piston cooling assembly. The poppet valve may be displaced to initiate the oil supply through the nozzle towards an end of each of a power stroke and an intake, or suction, stroke in the cylinder of the engine. Further, in an example, the poppet valve may have a valve stroke allowing the oil supply to be initiated for at least 120 degrees of crank rotation in a cylinder cycle. In another example, poppet valve 210 may have a valve stroke allowing oil supply to be activated continuously for at least 60 degrees of crank rotation. As such, there may be two sets of approximately 60 degrees of crank rotation in one cylinder cycle. Initiating the oil supply may include squirting a stream of oil via the nozzle to an underside of the piston, the underside of the piston including one or more openings (e.g., inlets) to one or more cooling passages. More specifically, the one or more cooling passages may traverse an interior of the piston and provide cooling to the piston when the oil supply is initiated.

FIG. 4 shows an example method 400 for activating an oil supply to provide cooling to a piston. The piston may be arranged within a cylinder of an engine, such as engine 10 of FIGS. 1 and 2. It shall be appreciated that method 400 may be performed by one or more pistons, such as piston 36 of FIGS. 1, 2, and 3, of one or more cylinders simultaneously or in a staggered manner, in order to activate the oil supply.

For example, in an engine with four cylinders arranged in an inline manner, such as that shown in FIG. 2, a first cylinder and a fourth cylinder may each be approaching a TDC position, such as during a compression and/or exhaust stroke. Simultaneously a second cylinder and a third cylinder may each be approaching a BDC position, such as in an intake and/or expansion stroke. Subsequently, the first cylinder and the fourth cylinder may each be approaching the BDC position while the second cylinder and the third cylinder may each be approaching the TDC position. In this example, each of the pistons arranged within the first cylinder and the fourth cylinder may receive oil at the same time within one engine cycle. Further, each of the pistons arranged within the second cylinder and the third cylinder may receive oil simultaneously during a different stroke in the engine cycle. In other examples, various combinations of piston motion in each respective cylinder may be desired depending on the number and orientation of the engine cylinders.

Method 400 may not be activated by a controller of the engine. As such, method 400 may occur due to the design of the piston cooling assemblies, as described in reference to FIGS. 2 and 3, associated piston motion, and associated hardware.

At 402, a piston, such as piston 36 of FIGS. 1, 2, and 3, moves toward BDC position in a cylinder, such as cylinder 30, during either an intake or power stroke. Then, at 404, a piston skirt (e.g., skirt 212 of piston 36) of the piston displaces a valve stem of a poppet valve (e.g., poppet valve 210) of a piston cooling assembly (e.g., piston cooling assembly 184 associated with cylinder 30). As described earlier in reference to FIG. 3, the poppet valve may be forced downwards (e.g., towards crankshaft 40) by the piston skirt as the piston continues towards BDC position. As such, the piston skirt may directly contact the valve stem prior to reaching BDC position, e.g., 30 CAD before BDC, and the piston skirt may remain in direct contact with the valve stem past BDC, e.g., 30 CAD after BDC. Thus, the stroke of the poppet valve may be approximately from 30 CAD before BDC to 30 CAD after BDC.

As the poppet valve shifts downwards within the valve body, an opening (such as, opening 308) of a nozzle (e.g., nozzle 208 as discussed in reference to FIGS. 2 and 3) may be unblocked at 406. Specifically, the nozzle may be opened. Opening of the nozzle initiates a spray of cooling oil stored in a valve body (e.g., valve body 206 as discussed in reference to FIGS. 2 and 3) to an underside of the piston at 408.

At 410, the oil supply comprising cooling oil enters a cooling passage (such as cooling passage 302, shown in FIG. 3) through an opening (e.g., inlet 304 of FIG. 3) positioned on the underside of the piston. Further, a stream of oil flows through the internal cooling passage(s) within the piston to provide cooling to the piston. A substantial portion of the oil supply from the nozzle may enter the opening of the cooling passage within the piston to comprise the stream of oil. As such, a nominal amount of the oil supply from the nozzle may not enter the cooling passage, and may instead be returned back into an oil sump in a crankcase of the engine. After the stream of oil flows through the cooling passage 302, the stream of oil may exit the cooling passage in the piston and return to the oil sump in the crankcase of the engine at 412. At 414, the piston begins to ascend toward top dead center (TDC) position during the cylinder cycle. As such, the piston may travel towards TDC position subsequent to the BDC position of 402. During piston motion towards TDC position, the poppet valve may also move upwards within the valve body and may gradually block the opening of the nozzle. At a given point during piston travel towards TDC position, the piston skirt disengages from the valve stem of the poppet valve of the piston cooling assembly at 416, allowing the poppet valve to return to a closed position wherein the nozzle is blocked. As described earlier, the piston skirt may fully disengage from the valve stem at approximately 30 CAD after BDC position. Thus, if BDC position is achieved at 180 CAD, the piston skirt may disengage from the valve stem of the poppet valve at approximately 210 CAD. As the piston skirt separates from the valve stem, the poppet valve may be released from external pressure (as exerted by the piston skirt) and may come to rest at the top of the valve body closing the opening of the nozzle. Thus, the nozzle is closed at 418 and oil supply to the piston underside may be obstructed. Specifically, the spraying of cooling oil to the underside of the piston terminates at 420. In this manner, the piston skirt of the piston may actuate (and deactivate) oil supply to the piston.

Oil supply may be initiated as the piston skirt comes into direct contact with the valve stem of the poppet valve (e.g., as the piston skirt travels towards BDC) and oil supply may be discontinued as the piston skirt loses contact with the valve stem of the poppet valve (e.g., as the piston travels away from BDC towards TDC).

The oil supply to the underside of the piston may be actuated via displacement of the valve stem of the poppet valve in the piston cooling assembly. Thus, oil supply may be actuated repeatedly to a piston of a given cylinder in a synchronous manner with reciprocating motion of the piston. The method 400 may repeat in synchronicity with a frequency of the piston reciprocating motion, or piston stroke, for each cylinder.

In one example, initiation of the oil supply from the nozzle may occur at approximately 30 CAD prior to BDC. In this example, BDC may occur at 180 CAD or 540 CAD in a given (single) cylinder cycle. In other words, oil supply may begin at approximately 150 CAD and/or at 510 CAD, as the piston skirt contacts and displaces the valve stem to open the nozzle of the piston cooling assembly. Further, termination of the oil supply may occur at approximately 30 CAD after BDC. In other words, at approximately 210 CAD and/or at approximately 570 CAD, the piston skirt may disengage from the valve stem and close the nozzle of the piston cooling assembly.

Said another way, the oil supply for a given piston may be activated for approximately 60 CAD symmetrically about BDC position (180 CAD and/or 540 CAD) of the given piston. Thus, in a single cylinder cycle, the given piston may receive cooling oil supply from approximately 150 CAD to 210 CAD, and between approximately 510 CAD and 570 CAD. Thus, in the single given cylinder cycle, oil supply to the piston may be actuated for a first portion of the cylinder cycle and may be deactivated for a second portion of the same cylinder cycle. The second portion of the cylinder cycle (when oil supply is deactivated) may be longer than the first portion of the cylinder cycle (when oil is activated).

Accordingly, a method for an engine may be provided, comprising repeatedly activating an oil supply to a piston only during a part of a cylinder cycle synchronous with a frequency of piston reciprocating motion. As such, the oil supply may be activated by the piston reciprocating motion. More specifically, the oil supply may be provided to the piston via a piston cooling assembly including a poppet valve. In one example, the poppet valve may have a valve stroke allowing the oil supply to be activated for at least 120 degrees of crank rotation in the cylinder cycle. In another example, poppet valve 210 may have a valve stroke allowing oil supply to be activated for at least 60 degrees of crank rotation in the cylinder cycle. Specifically, the oil supply may be activated continuously for at least 60 degrees of crank rotation in one cylinder cycle. As such, there may be two sets of approximately 60 degrees of crank rotation in one cylinder cycle. The oil supply may be activated by displacing the poppet valve via piston reciprocating motion, and, namely, a skirt of the piston that may displace the poppet valve. The piston cooling assembly may be fluidically coupled to and receives oil from an oil gallery. As such, activating the oil supply may comprise squirting a stream of oil to an underside of the piston. After cooling the piston, the oil may be returned to an oil sump in a crankcase of the engine.

Turning to FIG. 5, a map 500 of piston position and oil supply activation is shown with respect to an engine position, for one engine cylinder. Map 500 includes engine position along the x-axis in crank angle degrees (CAD). The one engine cylinder depicted herein may be one of the four cylinders of engine 10 of FIG. 2 (e.g., first cylinder 30, second cylinder 32, third cylinder 34 and/or fourth cylinder 38). The one engine cylinder includes a piston, such as piston 36, which receives cooling oil from an associated piston cooling assembly, such as piston cooling assembly 184 of FIGS. 2 and 3, including a poppet valve and a nozzle.

Plot 502 illustrates oil supply activation while curve 504 depicts piston positions (along the y-axis), with reference to their location from top dead center (TDC) and/or bottom dead center (BDC), and further with reference to their location within the four strokes (intake, compression, power and exhaust) of a first cylinder cycle and a second cylinder cycle. The first and second cylinder cycles each include four strokes, wherein the four stroke cycle includes an intake stroke, compression stroke, expansion stroke, and exhaust stroke, as shown. Further, each cylinder cycle includes two revolutions of the crankshaft (e.g., 720 CAD). As such, one engine cycle is completed with two revolutions of the crankshaft. The piston may operate cyclically and so its position within the combustion chamber may be relative to TDC and/or BDC.

As indicated by sinusoidal curve 504, during a first cylinder cycle, a piston gradually moves downward from TDC, bottoming out at BDC (at 180 CAD) by the end of the intake stroke. The piston then returns to the top, at TDC (at 360 CAD), by the end of the compression stroke. The piston then again moves back down, towards BDC (at 540 CAD), during the power stroke, returning to its original top position at TDC (at 720 CAD) by the end of the exhaust stroke (now at the end of the first cylinder cycle). For a second cylinder cycle (indicated as cylinder cycle #2), a substantially similar or same piston position profile may repeat as shown in the first cylinder cycle (indicated as cylinder cycle #1) in map 500 in FIG. 5. It will be noted that the second cylinder cycle may immediately follow cylinder cycle #1 in the one cylinder. As the piston in the depicted cylinder moves from TDC to BDC (curve 504) in the intake stroke of the first cylinder cycle, initiation of the oil supply may occur at approximately 30 CAD prior to the piston reaching BDC (plot 502). To elaborate, during the intake stroke of the first cylinder cycle, at CAD1 (e.g., 150 CAD) the piston skirt approaching BDC may displace the valve stem of the poppet valve of the piston cooling assembly. In one example, CAD1 may be 140 CAD whereas in another example CAD1 may be 160 CAD. In yet another example, CAD1 may be exactly 150 CAD.

By displacing the poppet valve, the opening of the nozzle is unblocked, as described in reference to FIGS. 2-4. As a result, the nozzle, such as nozzle 208, is opened, releasing cooling oil towards the underside of the piston for a duration T_O, as shown in plot 502. Specifically, cooling oil may be directed from the nozzle towards one or more opening(s) of the cooling passage(s) in the piston, as discussed in reference to FIG. 4. Further, cooling oil is delivered during a latter portion of the intake stroke.

After reaching BDC at 180 CAD, the piston may then begin to move upwards towards TDC during the compression stroke. The piston skirt moving toward TDC may disengage, or disconnect, from the valve stem of the poppet valve at approximately 30 CAD after BDC, indicated as CAD2. In one example, the piston skirt may disengage from the valve stem of the poppet valve at about 35 CAD after BDC. In another example, the piston skirt may disengage from the valve stem of the poppet valve at 25 CAD after BDC. In yet another example, the piston skirt may disengage from the valve stem at exactly 30 CAD after BDC. In other words, at about 210 CAD (e.g., CAD2) of the first cylinder cycle, the piston skirt may no longer displace the valve stem, and thus, the nozzle of the piston cooling assembly closes. Specifically, the opening of the nozzle is blocked by the poppet valve. In response, cooling oil flow through the nozzle may be blocked and oil may not be sprayed towards the opening(s) of the cooling passage(s) in the piston for a duration T_C, as shown in plot 502.

As such, oil may be sprayed for about 60 CAD (e.g., 30 CAD before BDC until 30 CAD after BDC) between 0 and 360 degrees of crank rotation. To elaborate, oil is sprayed to the piston underside from about 150 CAD until approximately 210 CAD which is a total duration of 60 CAD, represented as T_O in map 500.

Further, oil is supplied during the intake stroke of the piston towards the piston underside for a duration that is substantially half of T_O. Similarly, oil may be sprayed during the subsequent compression stroke of the piston towards the piston underside for a duration that is also substantially half of T_O. To elaborate, oil supply may be activated symmetrically around BDC position of the piston.

It will be noted that the poppet valve stroke may continue from CAD1 until CAD2, as shown at 506. It will also be noted, that cooling oil is supplied during an earlier portion of the compression stroke, and not towards the latter portion of the compression stroke.

As the piston in the depicted cylinder moves from BDC to TDC between about 210 CAD to 360 CAD (curve 504) in the compression stroke of the first cylinder cycle, the nozzle of the piston cooling assembly continues to be closed, and cooling oil is not sprayed towards the opening(s) of the cooling passage(s) in the piston. At 360 CAD, the piston is at TDC. As the piston in the depicted cylinder moves from TDC to BDC (curve 504) between 360 CAD and 540 CAD in the power stroke of the first cylinder cycle, initiation of the oil supply may occur again at approximately CAD3 or approximately 30 CAD prior to the piston reaching BDC (plot 502). In other words, during the power stroke of the first cylinder cycle, at about 510 CAD (e.g., CAD3) the piston skirt approaching BDC may displace the valve stem of the poppet valve of the piston cooling assembly. The opening of the nozzle is unblocked, releasing cooling oil towards the underside of the piston for the duration T_O, as shown in plot 502. Specifically, cooling oil may be directed from the nozzle towards one or more opening(s) of the cooling passage(s) in the piston. Thus, cooling oil is supplied during a latter part of the expansion stroke.

After reaching BDC at 540 CAD, the piston may then begin to move upwards towards TDC during the exhaust stroke. The piston skirt moving toward TDC may disengage, or disconnect, from the valve stem of the poppet valve at CAD4 or approximately 30 CAD after BDC at 540 CAD. In other words, at about 570 CAD (e.g., CAD4) of the first cylinder cycle, the piston skirt may no longer displace the valve stem, and thus, the nozzle of the piston cooling assembly closes. Specifically, the opening of the nozzle is blocked by the poppet valve and cooling oil spray towards the opening(s) of the cooling passage(s) in the piston may be ceased for the duration T_C, as shown in plot 502.

As such, oil may be sprayed for about 60 CAD (e.g., 30 CAD before BDC and 30 CAD after BDC) between 360 and 720 degrees of crank rotation. To elaborate, oil is sprayed to the piston underside from about 510 CAD until approximately 570 CAD which is a total duration of 60 CAD.

Further, oil is supplied during the power stroke of the piston towards the piston underside for a duration that is substantially half of T_O. Similarly, oil may be sprayed during the subsequent exhaust stroke of the piston towards the piston underside for a duration that is also substantially half of T_O. To elaborate, oil supply may be activated symmetrically around BDC position of the piston.

It will be noted that the poppet valve stroke may begin at CAD3, continue from CAD3 until CAD4, and end at CAD4, as shown at 512. As mentioned earlier, the poppet valve stroke at 506 is from CAD1 to about CAD2. Further, the poppet valve stroke lasts for approximately 60 CAD every time the associated piston is near BDC. Thus, during a single cylinder cycle in one cylinder, since the piston approaches BDC twice, the poppet valve stroke lasts for a duration of about 120 CAD. In other words, poppet valve 210 may have a valve stroke allowing oil supply to be activated continuously for at least 60 degrees of crank rotation. As such, there may be two sets of approximately 60 degrees of crank rotation in one cylinder cycle. Accordingly, oil is supplied to the piston of the one cylinder in one (e.g., single) cylinder cycle for about 120 CAD.

As the piston in the depicted cylinder moves from BDC to TDC between about 570 CAD to 720 CAD (curve 504) in the exhaust stroke of the first cylinder cycle, the nozzle of the piston cooling assembly continues to be closed, and cooling oil is not sprayed towards the opening(s) of the cooling passage(s) in the piston. At 720 CAD, the piston is at TDC and the first cylinder cycle is completed.

It will also be noted that oil is supplied to the piston during an earlier portion of the exhaust stroke, and not towards the end of the exhaust stroke.

Thus, oil supply for a piston in a cylinder is repeatedly activated only during a part of a cylinder cycle and the oil supply activation is synchronous with a frequency of piston reciprocating motion. It will also be noted that during a single cylinder cycle, the oil is supplied for a shorter duration than the duration for which oil is not supplied. To elaborate, in cylinder cycle #1 of map 500, oil is supplied for twice the duration of T_O while oil is not supplied for twice the duration of T_C. As shown, each duration of T_C is longer than the duration of T_O. Accordingly, the total duration of T_C (e.g., when oil is not supplied) is longer than the total duration of T_O (e.g., when oil is supplied). As mentioned earlier, oil is supplied in a cylinder cycle (e.g., a given cylinder cycle) for approximately 60 CAD. Thus, oil may not be activated for about 660 CAD of the cylinder cycle (e.g., the given cylinder cycle).

As such, each duration that oil is not sprayed, T_C, may be the same throughout cylinder cycles for a given cylinder piston. For example, oil may not be sprayed for about 660 CAD in each cylinder cycle. Similarly, oil may be delivered to the given cylinder piston for about 60 CAD during each cylinder cycle.

As shown in map 500, the duration of oil supply activation (T_O) may alternate with a duration of oil supply deactivation (T_C). Further, each duration of oil supply activation may be approximately the same duration. Likewise, each duration of oil supply deactivation may be approximately the same duration.

The aforementioned piston motion indicated by sinusoidal plot 504 and oil supply activation indicated by plot 502 is repeated for the second cylinder cycle as shown in FIG. 5. As such, oil activation may be actuated between CAD5 and CAD6 symmetrically about 180 CAD (BDC) (e.g., between 150 CAD during a second portion of the intake stroke and 210 CAD during a first portion of the compression stroke of the second cylinder cycle), and CAD7 and CAD8 symmetrically about 540 CAD (BDC) (e.g., between 510 CAD during the second portion of the power stroke and 570 CAD during the first portion of the exhaust stroke of the second cylinder cycle). In other words, CAD5 is substantially the same as CAD1, CAD6 is substantially the same as CAD2, CAD7 is substantially the same as CAD3, and CAD8 is substantially the same as CAD4 with reference to piston position and oil supply actuation profiles.

In one embodiment, the crank angle degrees at which the oil supply may be initiated and terminated is based on a valve stroke of the poppet valve, the valve stroke including a stroke length of the valve stem. The valve stroke allows for sufficient opening of a nozzle of the poppet valve to activate the oil supply for one or more pre-determined CAD. For example, the valve stroke of the poppet valve may be configured such that the valve stroke allows the oil supply to be activated in a continuous manner for at least 60 degrees of crank rotation as shown in FIG. 5. In this way, the valve stroke may be activated for approximately 120 degrees of crank rotation in the cylinder cycle (e.g., two sets of 60 degrees in one cylinder cycle). In other embodiments, the valve stroke may be increased such that the oil supply may be activated for more than 120 degrees of crank rotation in the cylinder cycle. In yet other embodiments, the valve stroke may be decreased such that the oil supply may be activated for less than 120 degrees of crank rotation in the cylinder cycle.

In this way, repeated activation of the oil supply may occur only during a part of a cylinder cycle synchronous with a frequency of piston reciprocating motion. In one example, the oil supply may be activated when the piston is within 30 CAD symmetrically before and after BDC (180 CAD and/or 540 CAD) for one or more cylinder cycles. Thus, oil supply activation may be synchronous with a frequency of the piston reciprocating motion for each cylinder.

It will be appreciated that additional cylinder cycles may proceed immediately after the second cylinder cycle having a substantially similar piston position and oil supply profile as described in FIG. 5. Thus, a method for an engine may be provided comprising delivering oil to a piston during a first portion of a cylinder cycle, the piston arranged within a cylinder of the engine, and not delivering the oil to the piston during a second portion of the cylinder cycle. The second portion of the cylinder cycle may be longer than the first portion of the cylinder cycle. More specifically, the first portion of the cylinder cycle may include a duration when the piston is substantially at bottom dead center position during each of an intake stroke and an expansion stroke. Further, delivering oil to the piston may include initiating oil delivery towards an end of an intake stroke and discontinuing oil delivery towards a beginning of a compression stroke (in other words, oil delivery may be discontinued subsequent to commencing the compression stroke), the compression stroke occurring immediately after the intake stroke. For example, oil delivery may be discontinued about 30 CAD after the compression stroke commences.

Similarly, delivering oil to the piston may include initiating oil delivery towards an end of an expansion stroke and discontinuing oil delivery subsequent to commencing an exhaust stroke, the exhaust stroke occurring immediately after the expansion stroke. For example, oil delivery may be discontinued about 30 CAD after the exhaust stroke commences.

In addition, delivering oil to the piston may include delivering oil via a piston cooling assembly, the piston cooling assembly including a valve body, a poppet valve, and a nozzle. The poppet valve may be displaced to open the nozzle within the valve body by the piston substantially at bottom dead center position.

FIG. 6 shows an example graph 600 of piston position with respect to a crankshaft rotation (crank angle degrees) within the four strokes (intake, compression, power and exhaust) of one cylinder cycle in each cylinder of a four cylinder inline engine with a firing order of 1-3-4-2. In such a four cylinder engine, the crankshaft rotates 720 degrees for each complete 4-stroke cycle, and each stroke is evenly distributed over the 720 degrees of each cycle, such that each stroke occurs for 180 degrees. As such, an engine cycle includes two revolutions of the crankshaft. Thus, graph 600 includes one engine cycle. As described, graph 600 includes engine position along the x-axis and piston position for each cylinder in the 4-cylinder engine along the y-axes. Specifically, plot 602 depicts piston position in a cylinder 1, plot 604 depicts piston position in a cylinder 2, plot 606 depicts piston position in a cylinder 3, and a plot 608 depicts piston position in a cylinder 4 along the y-axes.

As such, the example engine depicted in FIG. 6 may be engine 10 of FIG. 2 and the four cylinders of the example engine may be similar to first cylinder 30, second cylinder 32, third cylinder 34, and fourth cylinder 38 of FIG. 2. Each cylinder of the example engine may undergo a single cylinder cycle during the 720 degrees of crank rotation depicted in FIG. 6. Further, each cylinder may include a single piston. The crank rotation of 720 CAD in FIG. 6 includes four cylinder cycles, one cylinder cycle for each of the four cylinders shown (e.g., cylinder 1, cylinder 2, cylinder 3, and cylinder 4).

In the depicted example of graph 600, when the crank rotation is between 0 and 180 degrees of an engine cycle, cylinder 1 is in the intake stroke, such that its piston is moving towards BDC, cylinder 2 is in an exhaust stroke, such that its piston is moving towards TDC, cylinder 3 is in a compression stroke, such that its piston is moving towards TDC, and cylinder 4 is in a power stroke, such that its piston is moving towards BDC in an engine. Cylinder 2 and cylinder 3 may be 360 CAD apart from one another such that as the cylinder cycle begins (on left hand side of graph 600), each piston in cylinder 2 and cylinder 3 may be at BDC.

Between approximately 0 CAD and 30 CAD of crank rotation, the piston in cylinder 2 (shown at 614) and the piston of cylinder 3 (at 620) may receive oil from its associated piston cooling assembly. Moreover, oil is supplied to the pistons of cylinder 2 and cylinder 3 at about the same time, e.g., at the same crank rotation. It will be noted that oil is supplied to the piston of cylinder 2 during an earlier portion of the exhaust stroke while the piston of cylinder 3 receives oil at an earlier portion of the compression stroke. Oil supply to each of the pistons of cylinder 2 and cylinder 3 may be terminated after 30 CAD of crank rotation e.g. in the depicted engine cycle. As each cylinder cycle continues, each of the pistons in cylinder 2 and cylinder 3 reach TDC simultaneously when the engine position is at 180 CAD.

Similarly, cylinder 1 and cylinder 4 may be 360 CAD apart from one another such that each of cylinder 1 and cylinder 4 reach BDC simultaneously when the crankshaft rotation is at 180 CAD. As shown, each piston in cylinder 1 and cylinder 4 may receive oil from its associated piston cooling assembly between 150 CAD and 210 CAD (e.g., 180 CAD±30 CAD about BDC of each piston in cylinder 1 and cylinder 4), as shown in plot 602 and plot 608, respectively. Thus, pistons reciprocating in cylinder 1 and cylinder 4 may receive oil at about the same time in the crank rotation. To elaborate, each of the pistons of cylinder 1 and cylinder 4 may receive oil from approximately 150 degrees of crank rotation to about 210 degrees of crank rotation. However, piston of cylinder 1 may be at the end of its intake stroke while piston of cylinder 4 is at the end of its power stroke when the oil supply is initiated Further, the piston of cylinder 1 stops receiving oil about 30 degrees of crank rotation after BDC (e.g., 210 CAD) within a subsequent compression stroke while the piston of cylinder 4 stops receiving oil at about 30 degrees of crank rotation after BDC (e.g. 210 CAD) within a subsequent exhaust stroke, as shown as 610 and 626 respectively. Further, each of the pistons may receive cooling oil supply for a similar duration (e.g., approximately 60 CAD) as shown at 610 and 626, for cylinder 1 and cylinder 4, respectively. It will also be noted that when crank position is 180 CAD, pistons arranged in cylinder 2 and cylinder 3 do not receive oil since each of these pistons is at TDC position.

Oil supply actuation at a given crank position and oil supply duration may depend on the valve stroke of the poppet valve in the piston cooling assembly as described in FIGS. 3 and 5. The extent of the valve stroke for the piston cooling assembly associated with cylinder 1 is shown by 610 while the extent of the valve stroke for the piston cooling assembly associated with cylinder 4 is shown by 626. Specifically, oil supply may begin for each of the pistons (of cylinder 1 and cylinder 4) at 150 CAD and oil supply may be terminated for each piston of cylinder 1 and cylinder 4 at about 210 CAD.

Subsequently, when the crank rotates from 180 CAD and 360 CAD, cylinder 1 is in the compression stroke, such that its piston is moving towards TDC, cylinder 2 is in an intake stroke, such that its piston is moving towards BDC, cylinder 3 is in a power stroke, such that its piston is moving towards BDC, and cylinder 4 is in an exhaust stroke, such that its piston is moving towards TDC in the engine. As such, cylinder 1 and cylinder 4 reach TDC simultaneously when the crank position is at 360 CAD. Simultaneously, cylinder 2 and cylinder 3 may each reach BDC when the crank position is at 360 CAD.

Each piston of cylinder 2 and cylinder 3 may receive oil supply from approximately 330 CAD through 390 CAD (e.g., 360 CAD±30 CAD about BDC of each piston in cylinder 2 and cylinder 3), as shown in plot 604 and plot 606, respectively. Thus, pistons reciprocating in cylinder 2 and cylinder 3 may receive oil at about the same time, e.g., from before their respective pistons attain BDC, e.g. at about 330 CAD until after BDC, e.g. at 390 CAD. Further, each piston of cylinder 2 and cylinder 3 may receive cooling oil supply for a similar duration (e.g., 60 CAD) as shown at 616 and 622, respectively. To elaborate, each of the pistons of cylinder 2 and cylinder 3 may receive oil from approximately 330 degrees of crank rotation to about 390 degrees of crank rotation. However, piston of cylinder 2 may be at the end of its intake stroke while piston of cylinder 3 is at the end of its power stroke when the oil supply is initiated Further, the piston of cylinder 2 stops receiving oil about 30 degrees of crank rotation after BDC (e.g., 390 CAD) within a subsequent compression stroke while the piston of cylinder 4 stops receiving oil at about 30 degrees of crank rotation after BDC (e.g., 390 CAD) of the exhaust stroke that ensues the power stroke between 180 CAD and 360 CAD, as shown as 610 and 626 respectively.

It will also be noted that when engine position is 360 CAD, pistons arranged in cylinder 1 and cylinder 4 do not receive oil since each of these pistons is at their respective TDC position. The extent of the valve stroke for the piston cooling assembly associated with cylinder 2 is shown by 616 while the extent of the valve stroke for the piston cooling assembly associated with cylinder 3 is shown by 622. The extent of the poppet valve stroke may determine the duration of oil supply to the associated piston.

Next, when the crank rotates from 360 and 540 CAD, cylinder 1 is in the power stroke, such that its piston is moving towards BDC, cylinder 2 is in the compression stroke, such that its piston is moving towards TDC, cylinder 3 is in the exhaust stroke, such that its piston is moving towards TDC, and cylinder 4 is in the intake stroke, such that its piston is moving towards BDC in the engine. Since cylinder 1 and cylinder 4 are 360 CAD apart from one another, each of cylinder 1 and cylinder 4 reach BDC simultaneously when the engine position is at 540 CAD. Similarly, cylinder 2 and cylinder 3 may be 360 CAD apart from one another such that each of the cylinder 2 and cylinder 3 reach TDC simultaneously when the engine position is at 540 degrees.

As shown in plot 602 for the piston in cylinder 1 and plot 608 for the piston in cylinder 4, piston in cylinder 1 and piston in cylinder 4 may receive cooling oil supply at a crank rotation between approximately 510 CAD and 570 CAD (e.g., 540 CAD±30 CAD about BDC). Oil supply to piston of cylinder 1 around BDC at 540 CAD is shown at 612 and oil supply to piston of cylinder 4 around BDC at 540 CAD is shown at 628. It will be noted that at or about 540 CAD, piston of cylinder 2 and piston of cylinder 3 do not receive oil supply since each piston is at TDC position.

To elaborate, each of the pistons of cylinder 1 and cylinder 4 may receive oil from approximately 510 degrees of crank rotation to about 570 degrees of crank rotation. However, piston of cylinder 1 may be at the end of its power stroke while piston of cylinder 4 is at the end of its intake stroke when the oil supply is initiated Further, the piston of cylinder 1 stops receiving oil about 30 degrees of crank rotation after BDC (e.g., 570 CAD) in a subsequent exhaust stroke while the piston of cylinder 4 stops receiving oil at about 30 degrees of crank rotation after BDC (e.g., 570 CAD) in the subsequent compression stroke, as shown as 610 and 626 respectively.

Next, when the crank rotates from 540 CAD to 720 CAD of the engine cycle, cylinder 1 is in the exhaust stroke, such that its piston is moving towards TDC, cylinder 2 is in the power stroke, such that its piston is moving towards BDC, cylinder 3 is in the intake stroke, such that its piston is moving towards BDC, and cylinder 4 is in the compression stroke, such that its piston is moving towards TDC in the engine. As such, cylinder 1 and cylinder 4 reach TDC simultaneously when the crank position is at 720 CAD. At the same time, cylinder 2 and cylinder 3 may each reach BDC simultaneously when the crank position is at 720 CAD. As each piston in cylinder 2 and cylinder 3 reaches its respective BDC position at 720 CAD, piston skirts of the two pistons may actuate their respective oil supply at crank rotation of about 690 CAD (e.g., approximately 30 CAD prior to BDC at 720 CAD), as shown in plots 604 and 606, respectively. The oil supply for each of the two pistons (of cylinder 3 and cylinder 2) may occur through BDC at 720 CAD of the first engine cycle. Specifically, the oil supply shown at 618 (for cylinder 2) and 624 (for cylinder 3) may continue until about 30 CAD after BDC at 720 CAD of the depicted crank rotation. To elaborate, pistons in cylinder 2 and cylinder 3 may continue to receive oil in an ensuing respective cylinder cycle relative to the depicted cylinder cycles shown for cylinder 2 and cylinder 3 in graph 600. Thus, for the initial 30 CAD of the ensuing cylinder cycle within each of cylinder 2 and cylinder 3, each of the piston in cylinder 2 and cylinder 3 continues to receive cooling oil.

Thus, in another representation, an example method for an engine with four cylinders may comprise actuating oil supply to a first piston and a fourth piston simultaneously, each of the first piston and the fourth piston approaching bottom dead center position together, and not actuating oil supply to a second piston and a third piston, each of the second piston and the third piston approaching top dead center position together. In particular, each of actuating oil supply to the first piston and the fourth piston, and not actuating oil supply to the second piston and the third piston may occur within a common duration of crank rotation, the first common duration of crank rotation occurring from 0 crank angle degrees to 180 crank angle degrees. Further, each of actuating oil supply to the first piston and the fourth piston, and not actuating oil supply to the second piston and the third piston may occur within a second common duration of crank rotation, the second common duration of crank rotation occurring from 360 crank angle degrees to 540 crank angle degrees.

The method may further comprise actuating oil supply to the second piston and the third piston simultaneously, each of the second piston and the third piston approaching bottom dead center position together, and not actuating oil supply to the first piston and the fourth piston, each of the first piston and the fourth piston approaching top dead center position together. As such, each of actuating oil supply to the second piston and the third piston, and not actuating oil supply to the first piston and the fourth piston may occur within a third common duration of crank rotation, the third common duration of crank rotation occurring from 180 crank angle degrees to 360 crank angle degrees. Moreover, actuating oil supply to the second piston and the third piston, and not actuating oil supply to the first piston and the fourth piston may occur within a fourth common duration of crank rotation, the fourth common duration of crank rotation occurring from 540 crank angle degrees to 720 crank angle degrees. In each of the methods above, actuating oil supply may include displacing a poppet valve of a piston cooling assembly via piston motion, and unblocking a nozzle of the piston cooling assembly.

Thus, an example engine may include a cooling system comprising a plurality of piston cooling assemblies. Each of the plurality of the piston cooling assemblies may be associated with a piston of the engine such that one piston is associated with and receives oil from a corresponding piston cooling assembly. The piston cooling assembly may include a poppet valve that substantially blocks an opening of a nozzle of the piston cooling assembly when the poppet valve is in a first position. The poppet valve of each piston cooling assembly may be displaced by a skirt of the corresponding piston as the piston approaches BDC position. As such, each piston cooling assembly may be positioned within the engine such that a valve stem of the poppet valve contacts the skirt of the piston when the piston is at or about 30 CAD before BDC position. The piston cooling assembly may also be arranged such that the skirt of the piston releases and loses contact with the valve stem of the poppet valve at or about 30 CAD after BDC position. Further, contact between the skirt of the piston and the valve stem is maintained from about 30 CAD prior to BDC until about 30 CAD after BDC.

As the poppet valve is displaced from its first position via the skirt of the piston, the opening of the nozzle is unblocked. Further, an oil supply may be initiated towards the piston surface, specifically, an underside of the piston which may include one or more openings of cooling passages. As the piston moves towards TDC, the piston skirt loses contact with the valve stem of the poppet valve and the poppet valve is released to its first position blocking the flow of oil towards the piston.

Thus, piston motion may actuate oil supply from the piston cooling assembly. Further, the oil supply may be actuated in coordination with the reciprocating motion of the piston. Further still, oil supply is actuated only during a portion of a cylinder cycle, e.g., when the piston in a cylinder reaches (or just before reaching) bottom dead center position. Specifically, oil supply may be initiated in the cylinder cycle towards an end of each of a power stroke and an intake stroke, and oil supply may be terminated subsequent to a beginning of each a compression and an exhaust stroke in the cylinder of the engine The technical effect of repeatedly activating an oil supply only during a part of a cylinder cycle synchronous with a frequency of piston reciprocating motion is effective and efficient cooling of a reciprocating piston. Further, because piston motion activates oil cooling via the piston cooling assembly only during a stroke of the piston in which opening(s) of the cooling passages are more easily accessible, there may be reduced need for uneconomical and continuous operation of oil jets.

In another representation, a method for an engine may be provided, comprising displacing a poppet valve via a downward motion of a piston during a part of a cylinder cycle, the poppet valve arranged within a piston cooling assembly and the piston arranged within a cylinder of the engine, and activating an oil supply, the activating comprising spraying a stream of oil towards an underside of the piston via the piston cooling assembly. Specifically, the underside of the piston includes at least one opening for the cooling passages such that stream of oil is directed to the at least one opening. Further, the cooling passages may traverse an interior of the piston and enable cooling of the piston when the oil supply is initiated.

In this representation, the piston cooling assembly may be fluidically coupled to an oil conduit receiving oil from an oil gallery. In addition, the poppet valve may have a valve stroke allowing the oil supply to be activated for at least 120 degrees of crank rotation in a cycle of the engine. In one example, the oil supply may be activated towards an end of each of a power stroke and an intake stroke in the cylinder of the engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

repeatedly activating an oil supply only during a part of a cylinder cycle synchronous with a frequency of piston reciprocating motion, wherein the oil supply is activated by displacing a poppet valve of a piston cooling assembly via the piston reciprocating motion, and wherein a skirt of the piston cooling assembly displaces the poppet valve.

2. The method of claim 1, wherein activating the oil supply further comprises squirting a stream of oil to an underside of the piston cooling assembly.

3. The method of claim 2, wherein the poppet valve has a valve stroke allowing the oil supply to be activated for at least 60 degrees of crank rotation in the cylinder cycle.

4. The method of claim 2, wherein the piston cooling assembly is fluidically coupled to and receives oil from an oil gallery.

5. The method of claim 1, wherein oil is returned to an oil sump in a crankcase of the engine, the method further comprising not activating the oil supply during a remaining part of the cylinder cycle.

6. A method for an engine, comprising:

delivering oil to a piston during a first portion of a cylinder cycle, the piston arranged within a cylinder of the engine; and not delivering the oil to the piston during a second portion of the cylinder cycle, wherein the oil supply is delivered by displacing a poppet valve of a piston cooling assembly via a piston reciprocating motion, and wherein a skirt of the piston displaces the poppet valve.

7. The method of claim 6, wherein the second portion of the cylinder cycle is longer than the first portion of the cylinder cycle.

8. The method of claim 6, wherein the first portion of the cylinder cycle includes a duration when the piston is substantially at bottom dead center position during each of an intake stroke and an expansion stroke.

9. The method of claim 8, wherein the piston cooling assembly further includes a valve body and a nozzle.

10. The method of claim 9, wherein the poppet valve is displaced within the valve body by the piston substantially at bottom dead center position, and wherein the poppet valve is displaced to open the nozzle.

11. The method of claim 10, wherein delivering oil to the piston includes initiating oil delivery towards an end of an intake stroke and discontinuing oil delivery towards a beginning of a compression stroke, the compression stroke occurring immediately after the intake stroke.

* * * * *